US005388746A

United States Patent [19]

Hatchell et al.

[11] Patent Number: 5,388,746

[45] Date of Patent: Feb. 14, 1995

[54] SEPARATOR/FOLDER BAG MACHINE

[75] Inventors: Peter J. Hatchell, New Franken; Ronald L. Lotto, Bonduel; Ernest H. Teske; Donald J. Bauknecht, both of Green Bay, all of Wis.

[73] Assignee: FMC Corporation, Chicago, Ill.

[21] Appl. No.: 770,811

[22] Filed: Oct. 4, 1991

Related U.S. Application Data

[62] Division of Ser. No. 613,436, Nov. 9, 1990, abandoned.

[51] Int. Cl.[6] ..... B65H 35/10

[52] U.S. Cl. ..... 11.225/100; 225/4; 493/234

[58] Field of Search ..... 225/4, 100, 106, 5, 225/101; 226/44; 493/3, 8, 22, 23, 24, 30, 34, 234, 235, 236, 238, 239

[56] References Cited

U.S. PATENT DOCUMENTS

| | | | |
|---|---|---|---|
| 2,268,190 | 12/1941 | Copeland | 225/100 |
| 3,509,799 | 5/1970 | Weis | 493/197 |
| 3,730,411 | 5/1973 | Brockmuller | 225/100 |
| 3,799,418 | 3/1974 | Maroschak | 226/44 |
| 4,284,221 | 8/1981 | Nagel | 225/106 |
| 4,380,446 | 4/1983 | Dickson | 493/197 |
| 4,529,114 | 7/1985 | Casper | 225/4 |
| 4,642,084 | 2/1987 | Gietman, Jr. | 493/197 |
| 4,688,708 | 8/1987 | Irvine | 225/106 |
| 4,730,762 | 3/1988 | Felix | 225/106 |

*Primary Examiner*—Jack W. Lavinder
*Attorney, Agent, or Firm*—Douglas W. Rudy

[57] ABSTRACT

A separator/folder bag machine for developing individual, folded, plastic bags. A pair of high speed separation rollers, actuated by means of a servo motor driven eccentric linkage, engages a continuous plastic web to separate individual plastic bags formed tin the web. A pair of parallel, wide belts, and a pair of similar, overlying belts, engage both sides of the separated bags and transport the bags to a plurality of folding stations. Air jets at selected locations in the folder/separator controllably direct the bags through pairs of nip rolls to fold the bags along predetermined fold lines. Sensors in the folder/separator sense abnormal conditions and deactivate particular fold stations to reject improperly formed bags. A two speed slowdown mechanism at the discharge end of the separator/folder slows the folded bags to facilitate downstream handling. An optional stacker and indexing conveyor automatically stacks predetermined numbers of folded bags, aligns and compresses the bags to form an easily handled stack, and conveys the formed and compressed stack to downstream apparatus for further handling.

2 Claims, 12 Drawing Sheets

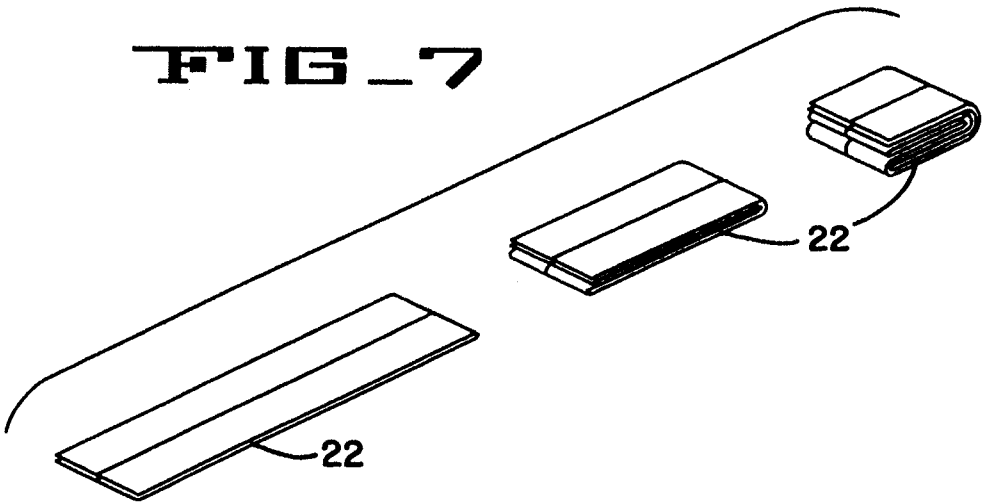
FIG_7
FIG_6
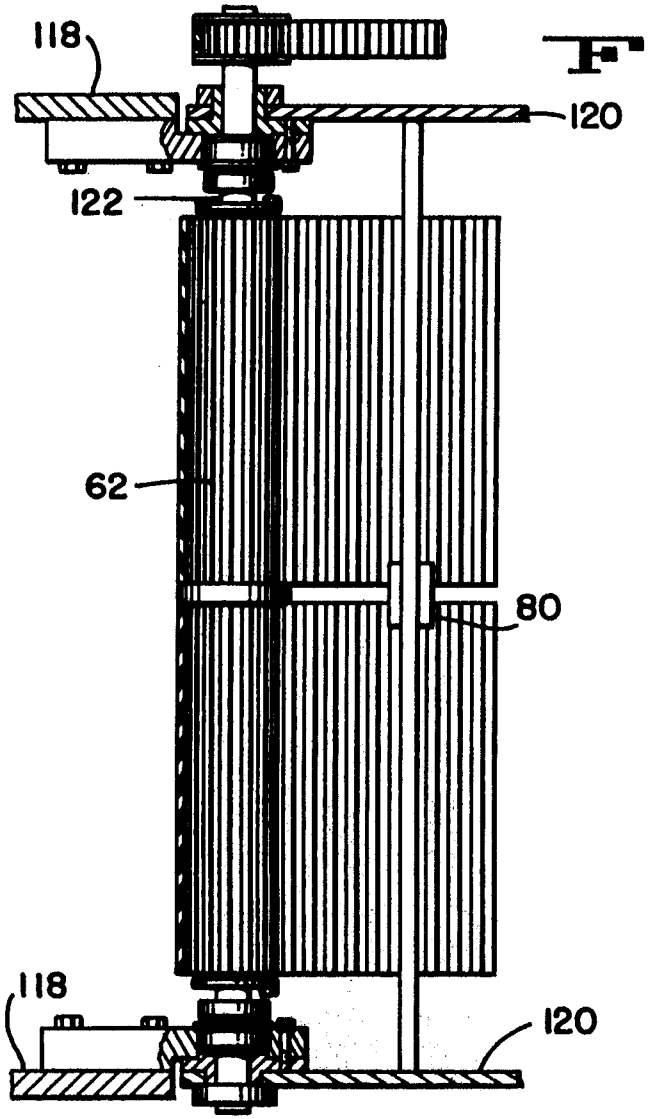

SEPARATOR/FOLDER BAG MACHINE

This is a division of application Ser. No. 07/613,436 filed Nov. 9, 1990 now abandoned.

BACKGROUND OF THE INVENTION

This invention relates generally to bag making machines and, more particularly, to separator/folder mechanisms for separating and folding plastic bags in a bag making operation.

Plastic bags of various types are in widespread use throughout the world. Such bags can be economically manufactured in large quantities from extruded plastic films, and a variety of machines have been developed for automating the bag making process. Every advancement that makes it possible to produce bags with greater speed and efficiency results in greater savings to tile manufacturers and users of plastic bags.

Plastic bags are typically formed from a continous plastic web that can be in the form of a flattened continuous tube or a continuous folded sheet. By forming bottom welds, in the case of a tubular web, or side welds, in the case of a folded web, individual bags are defined. Typically, a perforation adjacent the bottom or side welds allows separation of the individual bags. Until separation, the bags remain strung together in a continuous ribbon.

For a variety of reasons, additional processing is often necessary before tile bags can, as a practical matter, be offered for sale. For example, a typical run of bags may include far more bags than any one consumer could possible require at one time. In addition, the need to separate the bags manually could detract from the bags' convenience and overall utility. Finally, in the case of larger bags, such as lawn and trash bags, the sheer size of each bag makes handling and packaging difficult unless the bags are first folded down to a more manageable size. Accordingly, a variety of machines have been developed for automatically separating, folding and stacking plastic bags formed from continuous plastic webs.

In one prior machine, bag separation was accomplished by operating a downstream set of nip or separation rollers at a higher speed that an upstream set of rollers. As the perforated web encountered the downstream separation rollers, the higher speed of the rollers pulled the web, thereby tearing it along the perforations. A pneumatic cylinder periodically cycled the high speed separation rollers into contact with each other to initiate the separating sequence. Although effective, the use of a pneumatic cylinder to cycle the separation rollers limited the maximum machine operating speed and caused inaccuracies in the separation spacing.

In one prior machine, a plurality of rope belts were used to convey the separated bags between the separating nip rolls and a number of downstream folding stations. During operation, it was not uncommon for the side edge of a bag to wrap itself around one of tile ropes. This caused jams and required that the machine be shut down while the jam was cleared. Valuable production time could thus be lost.

In view of the foregoing, it is a general object of the present invention to provide a new and improved machine for separating and folding articles formed from a continuous plastic web.

It is a further object of the present invention to provide a new and improved separating and folding apparatus that can perform separations with accuracy at high speeds.

It is a still further object of the present invention to provide a new and improved separating and folding mechanism that can handle a variety of product widths without frequent jamming.

SUMMARY OF THE INVENTION

The invention provides a separator for separating individual sheets from a continuous plastic web having transverse perforations formed therein. The separator comprises an infeed mechanism for advancing the plastic web at a predetermined speed and further comprises a pair of nip rollers located downstream of the infeed mechanism and mounted for reciprocating movement into and out of engagement with each other. The nip rollers operate when engaged to advance the plastic web at a speed greater than the predetermined speed so as to cause the continuous plastic web to separate along the next adjacent transverse perforation between the nip rollers and the infeed mechanism. A linkage, including an eccentric, is coupled to at least one of the nip rollers for reciprocating the nip rollers into engagement with each other in response to rotation of the eccentric. A motor is provided for rotating the eccentric to reciprocate the nip rollers into engagement with each other and thereby cause the plastic web to separate along the next adjacent downstream perforation.

The invention also provides a separator/folder for separating individual sheets from a continuous plastic web having transverse perforations formed therein and for folding the separated individual sheets along at least one predetermined fold line. The separator/folder comprises a separator mechanism for separating individual sheets from the continuous plastic web and further comprises a plurality of fold stations operable to fold the separated, individual sheets along predetermined fold lines. A plurality of belts are provided for conveying the separated individual sheets between the separator mechanism and the fold stations. Each of the belts defines a conveying surface having a width greater than the width of the separated individual sheets and includes a continuous side margin that extends beyond the adjacent side margin of the conveyed individual sheets.

The invention also provides a separator/folder for separating individual sheets from a continuous plastic web having transverse perforations formed therein and for folding the separated individual sheets along at least one predetermined fold line. The separator/folder comprises a separating mechanism for separating individual sheets from the continuous plastic web and further includes a plurality of fold stations operable to fold the separated, individual sheets along predetermined fold lines. The separator/folder further includes a belt assembly for conveying the separated individual sheets between the separator mechanism and the fold stations. The belt assembly comprises a first belt having an undersurface and an upper surface for supporting, on the upper surface, the separated individual sheets. The belt assembly further includes a second belt having an undersurface overlying the first belt so as to sandwich the separated individual sheets between the upper surface of the first belt and the lower surface of the second belt. Means are provided for simultaneously moving the first and second belts in conjunction with each other so as to transport the separated individual sheets between the first and second belts with substantially no relative longitudinal movement between the upper surface of the first belt and the separated individual sheets, and between the lower surface of the second belt and the separated individual sheets. The moving means includes a first roller engaging the lower surface of the first belt and further includes a second roller displaced from the first roller and engaging the lower surface of the second belt. The first and second rollers are arranged to change the direction of the first and second belts and to separate the first and second belts during the change of direction so that relative differences in the longitudinal surface velocities of the first and second belts over the change of direction are not imparted to the conveyed, separated, individual sheets.

The invention further provides a separator/folder for separating individual sheets from a continuous plastic web having transverse perforations therein and for folding the separated individual sheets along at least one predetermined fold line. The separator/folder comprises a separator mechanism for separating individual sheets from the continuous plastic web, and further comprises a plurality of fold stations operable to fold the separated individual sheets along predetermined fold lines. A belt assembly is provided for conveying the separated individual sheets among the separator mechanism and the fold stations. A slowdown mechanism is positioned downstream of the fold stations and functions to slow the conveyed speed of the separated, individual sheets as the sheets are discharged from the separator/folder. The slowdown mechanism includes a pair of nip rolls positioned to engage the separated, individual sheets as the sheets are discharged from the separator/folder. The slowdown mechanism further includes driving means coupled to the nip rolls for operating the nip rolls at a first predetermined speed when one of the separated, individual sheets first engages the nip rolls, and for reducing the speed of the nip rolls to a second predetermined speed slower than the first predetermined speed as each of the sheets transits through the nip rolls. Following discharge of the sheet, the driving means increases the speed of the nip rolls to the first predetermined speed prior to engagement of the next following sheet with the nip rolls.

BRIEF DESCRIPTION OF THE DRAWINGS

The features of the present invention which are believed to be novel are set forth with particularity in the appended claims. The invention, together with the further objects and advantages thereof, may best be understood by reference to the following description taken in conjunction with the accompanying drawings, wherein like reference numerals identify like elements, and wherein:

FIG. 6 is a top plan view of a conveyor belt incorporated in the separator/folder and constructed in accordance with one aspect of the invention.

FIG. 7 is diagramatic representation of the folding sequence performed by the separator/folder shown in FIG. 1.

DESCRIPTION OF THE PREFERRED EMBODIMENT

Figure 1:
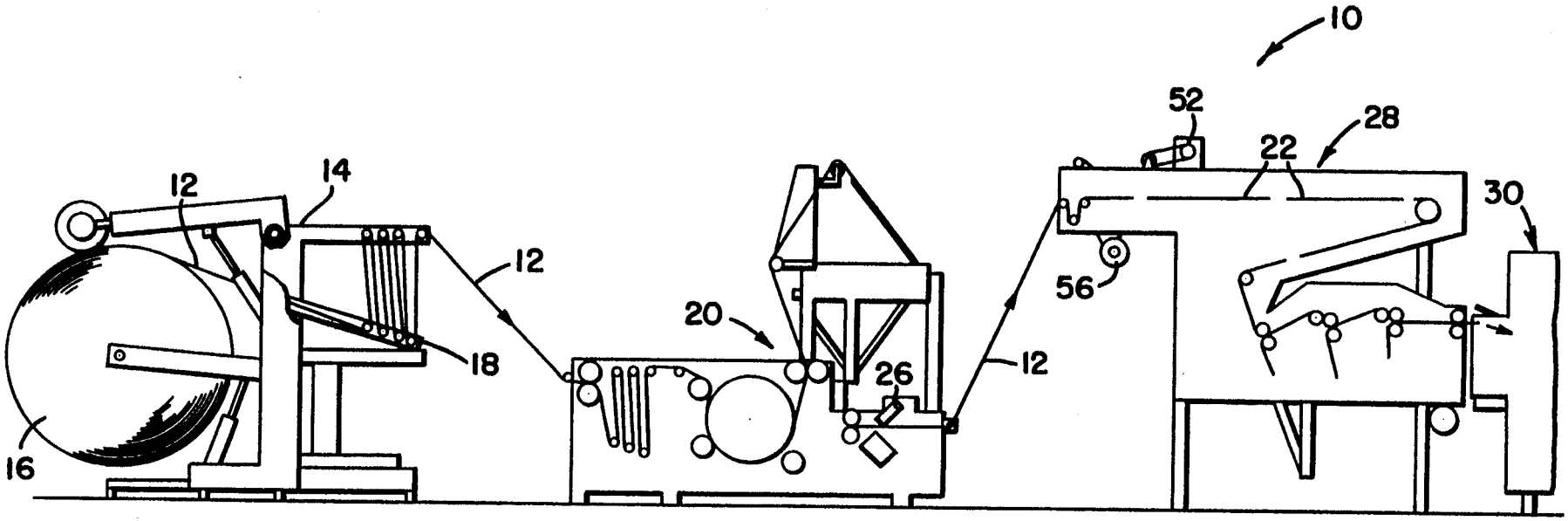
FIG. 1 is a simplified side elevation view of a bag making production line including a separator/folder embodying various features of the invention.

Referring to the drawings and, in particular to FIG. 1, a bag making production line is illustrated. In the illustrated embodiment, the production line functions to convert a continuous, tubular, plastic web into stacks of individual, folded plastic bags. The production line includes a driven unwind machine of known construction that contains a supply roll of the continuous, tubular, plastic web. The unwind machine unwinds the web from the roll and discharges it through a dancer mechanism that functions to keep a substantially constant tension on the discharged web.

From the unwind machine, the web is fed into a rotary bag machine of known construction. The rotary bag machine forms a plurality of regularly spaced, transverse, bottom welds across the web. Individual bags are defined between the spaced bottom welds. Following formation of the bottom welds, the web passes through a plurality of folding boards that fold the side edges of the web inwardly along fold lines extending parallel to the longitudinal axis of the web. The width of the web as it leaves the bag machine is thus reduced considerably. A perforating mechanism or knife adjacent the output of the bag machine 10 perforates the web 12 immediately downstream of each bottom weld to permit separation of the individual bags 22. The bags remain connected in a continuous ribbon or web 12, however, as they leave the bag machine 20.

From the bag machine 20, the welded, folded and perforated web 12 is fed to a separator/folder machine 28 constructed in accordance with various aspects of the invention. The separator/folder 28 functions to separate the continuous plastic web 12 along the perforations into individual bags and then to fold the individual bags 22 along predetermined fold lines extending across the width of each bag 22. From the bag machine 28, the folded bags 22 are delivered to a bag stacker and indexing conveyor 30. The bag stacker and indexing conveyor 30 stacks the folded bags 22 in predetermined numbers and transfers the stacks downline for further processing.

Figure 2:
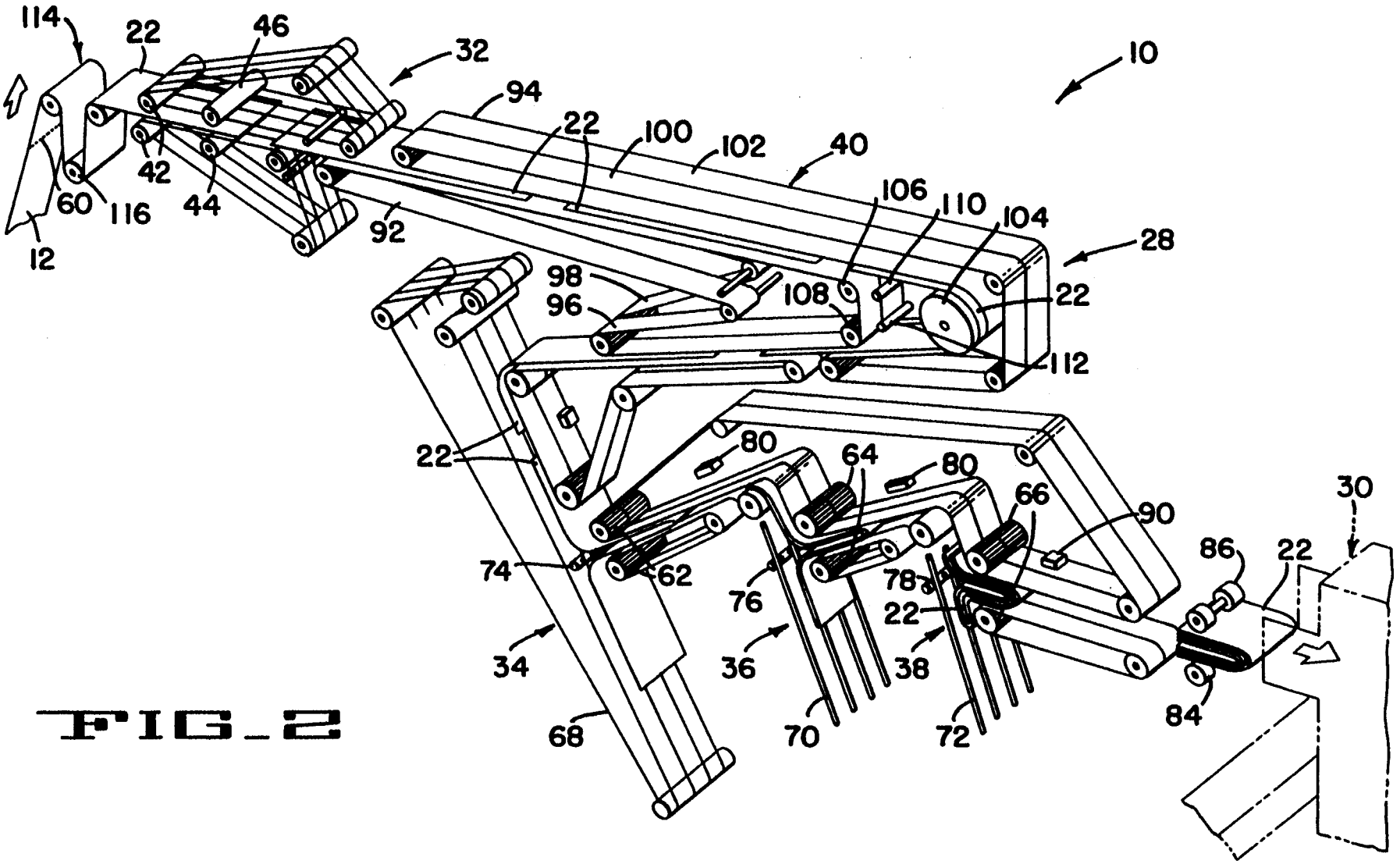
FIG. 2 is a simplified perspective view of the separating, conveying and folding mechanisms of the separator/folder shown in FIG. 1.

Referring to FIG. 2, the separator/folder machine 28 includes, in combination, a separator mechanism 32 for separating the individual bags, a plurality of fold stations 34, 36 and 38 for folding the bags 22 across predetermined fold lines and a conveyor mechanism for conveying the bags 22 between the separator mechanism 32 and the fold stations 34, 36 and 38.

Figure 3:
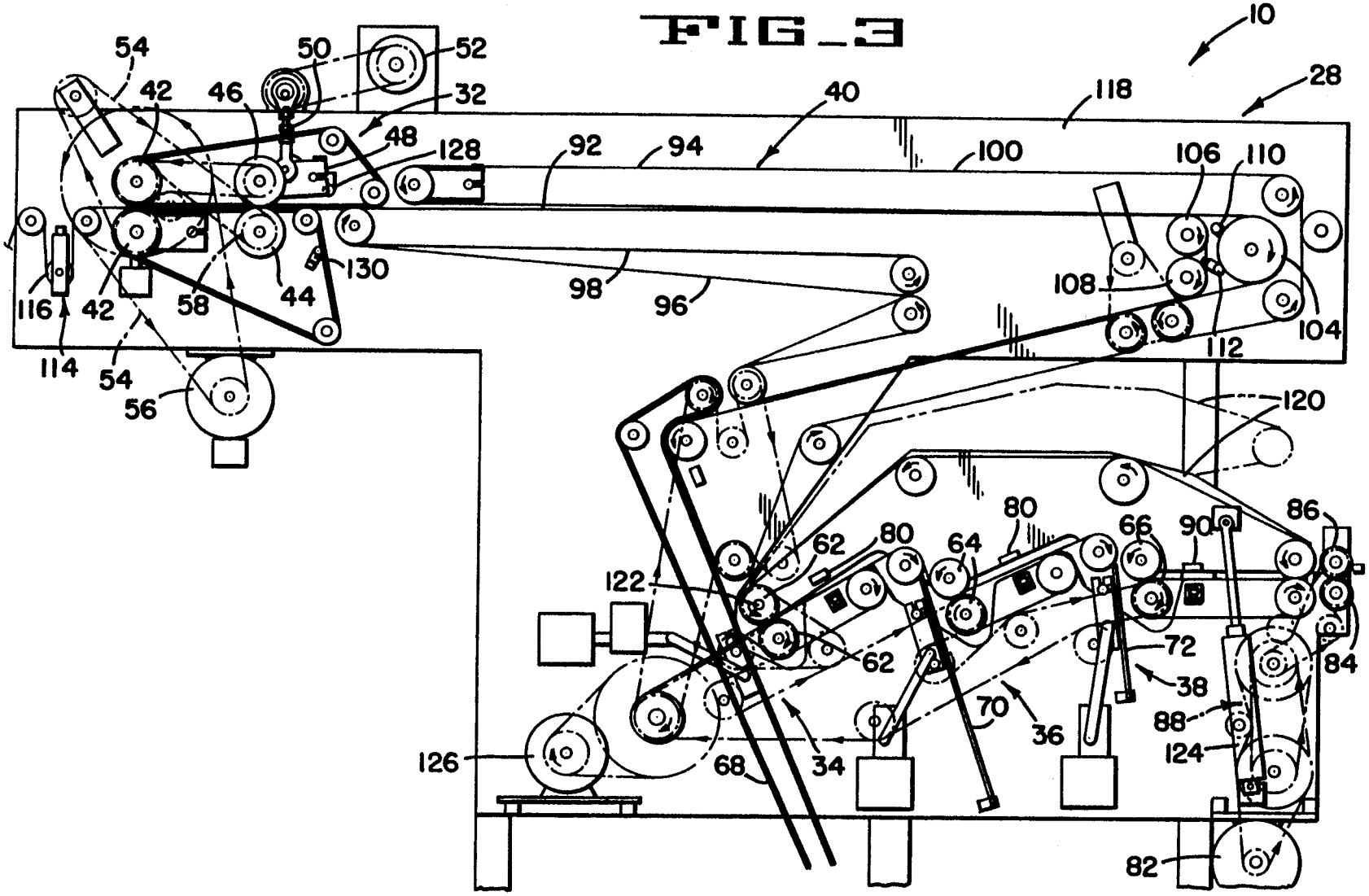
FIG. 3 is a side elevation view of the separator/folder shown in FIG. 1.

Referring to FIGS. 2 and 3, the separator mechanism 32 includes an infeed mechanism operable to advance the plastic web at a predetermined speed. As can be seen in FIG. 2 and FIG. 3 a "rope belt" transport system is used wherein ropes run in grooves in various rollers of the system as is well known in the art. The grooves in the rollers accommodate the ropes at the depth such that the level of the rope in the grooves is at or slightly lower than the normal surface of the rollers. As is apparent from FIG. 3, the fixed lower roller 44 and the other separation roller or upper nip roller 46 are provided with grooves to accommodate the ropes such that the normal surfaces of the separation rollers can come together as necessary to "grip" the top and obverse sides of the web 12. In the illustrated embodiment, the infeed mechanism comprises a pair of nip rollers 42. Downstream of the nip rollers 42, the separator mechanism 32 further includes an additional pair of nip or separation rollers 44, 46. The separation rollers 44, 46 operate at a speed higher than the infeed nip rollers 42 and are mounted for reciprocating movement into and out of engagement with each other. In particular, the upper nip roller 46 is mounted on a bracket 48 that, in turn, pivots substantially up and down relative to the fixed lower roller 44. The pivoting bracket 48, in turn, is coupled through an eccentric linkage 50 to a drive motor 52 so that operation of the motor 52 results in reciprocating movement of the upper roller 46 into and out of engagement with the lower roller 44. The lower roller 44, in turn, is coupled through a plurality of drive belts 54 to an infeed drive motor 56 that also operates the infeed rollers 42. By reducing the size of the drive pulley 58 coupled to the lower separation roller 44, the separation rollers 44, 46 operate faster than the infeed rollers 42. In one embodiment, the separation rollers 44, 46 are operated at a speed 25% greater than the speed of the infeed rollers 42. In addition, the separation rollers 44, 46 are mounted so that the maximum gap between the upper and lower separation rollers is approximately one-eighth inch. When the infeed and separation rollers contact the web 12 simultaneously, the speed differential between the sets of rollers that is, the speed differential between the infeed roller set 42/42 and the set of separator roll rollers 44 and 46, creates a longitudinally directed tension in the web 12. If a line of perforations 60 marking the juncture between adjacent bags 22 is present between the infeed rollers 42 and separation rollers 44 and 46, the tension thus developed is sufficient to tear the web along the perforations 60 and thus separate the individual bags 22.

To ensure proper separation of the bags 22, it is necessary that the reciprocating movement of the separation rollers 44 and 46 into engagement with each other occurs only when the perforations 60 between adjacent bags 22 are properly located between the infeed rollers 42 and separation rollers 44 and 46. Preferably, to ensure proper tracking of the separated bags 22 through the remainder of the separator/folder mechanism 28, the separation takes place when the perforations 60 are adjacent the separation rollers 44, 46. To this end, the motor 52 for operating the eccentric linkage 50 is preferably a servo motor that operates in accordance with web position information derived from the upstream bag making machine 20. In particular, a position indicator coupled to the perforating knife 26 of the upstream bag machine 20 provides web position information to a means responsive to the position indicator namely the servo motor 52, and the motor 52 then operates to reciprocate the separation rollers 44 and 46 so that the rollers engage the web 12 when the next adjacent downstream web perforation 60 is between the infeed and separation rollers 44 and 46.

Figure 4:
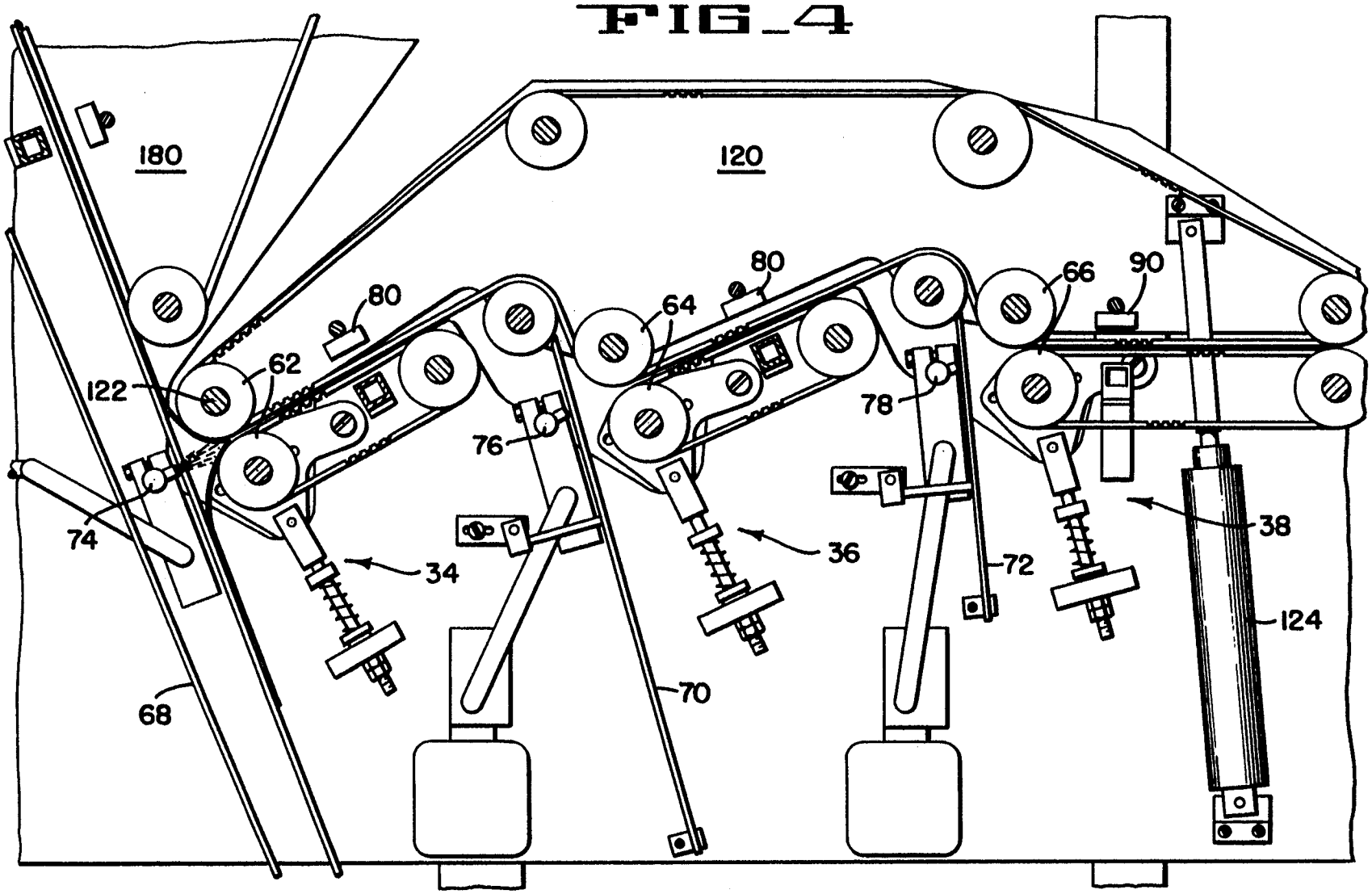
FIG. 4 is an enlarged, fragmentary, side elevation view of the folding stations included in the separator/folder shown in FIG. 1.
Figure 5:
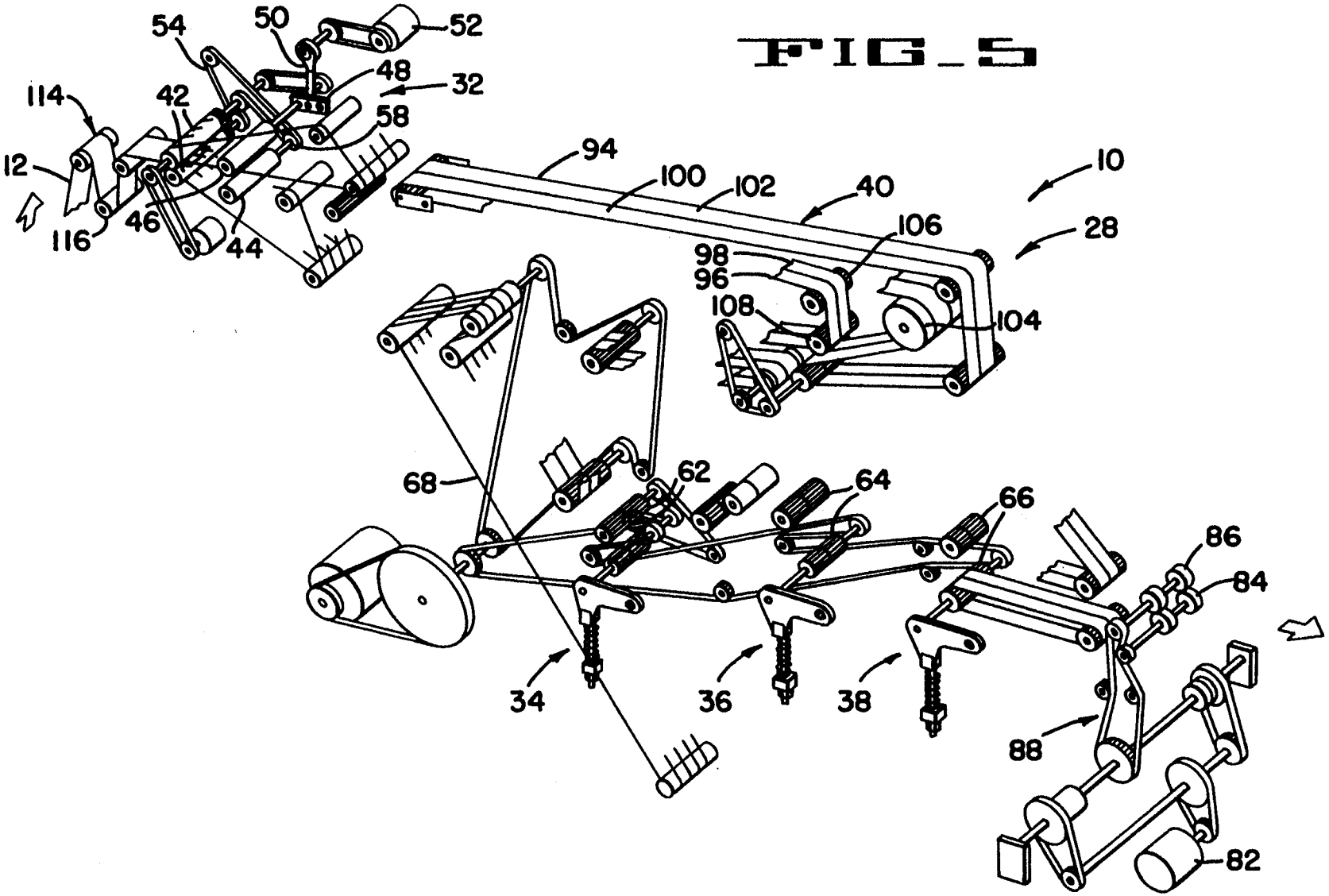
FIG. 5 is a simplified perspective view of the drive linkages for actuating various elements of the separator/folder shown in FIG. 1.

Referring further to FIGS. 2, 3 and 4, the separator/folder mechanism 28 includes three separate fold stations 34, 36 and 38. Each of the fold stations is capable of folding an individual bag 22 once along a fold line extending across the width of the bag perpendicular to the side edges thereof. As illustrated, each fold station 34, 36 and 38 includes a pair of nip rollers 62, 64 and 66, respectively that rotate in the directions shown by the arrows in FIG. 3. A rope belt conveyor 68, 70 and 72 adjacent each of the folding nip rolls 52, 64 and 66 functions to transport the bags 22 past the nip rolls. An air jet 74, 76 and 78 is located behind each conveyor and is directed through the rope belt toward the nip between the folding rolls. When the air jet 74, 76 and 78 is actuated the bag 22 carried on the adjacent conveyor 68, 70, 72 is tucked between the folding rolls 62, 64 and 66 as best seen in FIG. 2. A fiber optic pickup scanner 80 mounted adjacent each conveyor 68, 70, 72 senses the lead edge of each bag 22 as it travels past. The pickup scanner 80 actuates a counter that times actuation of the air jets 74, 76, 78 so that actuation occurs when the middle of the bag is opposite the jet 74. This causes the bag to be folded in half as it travels through the folding rollers 62. At the next folding station 36, the process is repeated thereby folding the bag in half once again. At the next folding station 38, the bag 22 is folded in half still again. At this point, the bag 22 has been folded three times to one-eighth its original length. This is best seen in FIG. 7. As best seen in FIG. 4, one roller in each pair of folding rollers is preferably spring loaded so that the folding rollers automatically adjust to the thickness of the bag being folded.

Once the bag passes through the final folding station 38, it is ready for transfer to the stacker mechanism 30. In a high speed bag making operation, each bag 22 can be moving at considerable speed as it passes through the separator/folder mechanism 25. Such high speed can make it difficult to stack the folded bags 22 with accuracy and consistency. Accordingly, the separator/folder 28, in accordance with one aspect of the invention, includes a slowdown mechanism that reduces the speed of each folded bag as it exits the separator/folder mechanism 28. The slowdown mechanism includes a motor 82 and a pair of slowdown wheels 84, 86 coupled to the motor 82 through a two speed clutch mechanism 88. When the clutch is not engaged, the rollers 84, 86 operate at a speed that substantially matches the speed of the bags through the separator/folder mechanism 28. When the clutch is engaged, the speed of the slowdown rollers 84, 86 is reduced by approximately one-third. An optic sensor 90 senses when each folded bag 22 emerges from the third folding station 38. The sensor 90 triggers a counter that controls actuation of the clutch so that when approximately one-third of the folded bag 22 remains left to pass through the slowdown rolls 84, 86, the slowdown rolls shift to slower speed operation. This has the effect of slowing the speed at which the folded bags are discharged from the separator/folder mechanism 28.

In accordance with one aspect of the invention, a substantially jamproof conveying system 40 is provided for conveying the bags between the separator mechanism 32 and the various folding stations 34, 36 and 38. In the illustrated embodiment, the conveyor 40 comprises a plurality of wide timing belts 92, 94 arranged generally so that the conveyed bags 22 are sandwiched between the upper surface of a lower belt 92 and the under surface of an adjacent, overlying, upper belt 94. Preferably, the upper and lower belts 92 and 94 each comprise a pair of parallel, side-by-side belts 96, 98 and 100, 102 separated by a small gap. In one embodiment, each of the belts 96–102 is approximately ten inches wide, and the gap between adjacent belts 96, 98 or 100, 102 is approximately one-half inch. This results in a conveying surface that is approximately twenty and one-half inches wide, which is wider than any of the bags 22 intended to be handled by the particular separator/-folder 28. As a result, the belts 92, 94 extend under and beyond the side margins of the conveyed bags 22 thereby reducing the likelihood that a bag will wrap around the side of the belt and cause a jam.

In accordance with another aspect of the invention, the jamproof conveyor 40 is arranged so that relative longitudinal movement between the upper and lower belts 92, 94 as the direction of the belts changes is not transferred to or felt by the conveyed bags 22. In particular, a change in the direction of tile conveyor run is achieved by running the upper belt 94 over a first roller 104 while running the lower belt 92 over a pair of additional rollers 106, 108 that are displaced laterally from the first roller 104. When so arranged, the upper and lower belts 92, 94, which normally lie adjacent each other, are separated while they undergo a change in direction. By the same token, the belts 92, 94 are only in close proximity to each other when the run of the conveyor 40 is substantially straight. In operation, the conveyed bags 22, which ordinarily are sandwiched between the upper and lower belts 92, 94, pass over the first roller 104 and under the overlying belts 100, 102, while the underlying belts 96, 98 pass over the inner rollers 106, 108 while separated from both the bag 22 and the overlying belts 100, 102. After the change of direction is accomplished, the belts are once again brought back together. An upwardly directed air jet 110, and a downwardly directed air jet 112, between the displaced rollers ensure that the conveyed bag 22 remains against the underside of the upper belt 94 as it passes around the roller 104. The advantage of this roller and belt arrangement is that it avoids bag distortion that might occur if the two belts and the bag sandwiched therebetween were to pass over a single roller.

In accordance with yet another aspect of the invention, a dancer mechanism 114 is provided upstream of the infeed rollers 42. The dancer mechanism 114 senses tension in the plastic web 12 as it enters the separator/-folder 28 and provides feedback to the infeed motor 56 so as to ensure that the infeed speed matches the outfeed speed of the upstream bag machine. The dancer itself 116 has a relatively small displacement range of only about 1/16 to ⅛ of an inch. The signal displacement range of the dancer 116 avoids shifting the perforation 60 in the web relative to the separating rolls 44, 46 as can result when dancers having a larger displacement are utilized. Use of the small displacement dancer 116 avoids such shifting or phasing errors and ensures that the perforations remain properly located relative to the separation rolls 42, 46 during the separating sequence.

The separator/folder mechanism frame is arranged in two parts 118, 120 that are moveable relative to each other around a pivot 122. The frame members 118, 120 and various rollers are arranged so that, when the frame members are pivoted apart, adjacent rollers separate along the path followed by the bags 22 through the separator/folder mechanism 28. This makes it very easy to clear the machine in the event of a jam. Preferably, a user actuated pneumatic cylinder 124 is included for pivoting the frame halves 118, 120 relative to each other.

To enhance versatility, the separator/folder 28 can be operated so that the separator mechanism 32 operates independently of the folder mechanism 34, 36 38. To this end, separate motors 56 and 126 are provided for operating the separating and folding sections of the machine. In addition, a downwardly directly air jet 128 is positioned adjacent the downstream end of the separator mechanism 32. When actuated, the air jet 128 diverts the separated bags 22 away from the main conveyor 40 and onto the floor below the machine 28. In this manner, the separator mechanism 32 can continue to operate in synchronization with the upstream bag making machine 20 while the folder mechanism is shut down as, for example, to clear a jam. This avoids shutting down the entire production line 10. An additional upwardly directed air jet 130 functions to divert the separated bags 22 once again into the main conveyor 40 after the folding mechanism has been returned to operation.

In accordance with still another aspect of the invention, the separator/folder mechanism 28 can be operated so as to provide one, two or three folds in the finished bag. To this end, the air jets 74, 76, 78 that direct the bags into folding rollers can, optionally, be actuated when the leading edge, rather than the middle, of a bag 22 is opposite the folding rollers. When the leading edge, rather than the middle, of the bag is directed through the folding rollers, the bag passes through the rollers unfolded. By operating one, two or three of the air jets so that the middle, rather than leading edge, of the bag is directed into the folding rollers, one, two or three complete folds can be achieved. Similarly, any one of the air jets 74, 76 or 78 can be selectively deactivated so that the bag is not directed into the folding rollers at all. In such case, the bag continues past the folding rollers and is deposited onto the floor. Optic sensors (not shown) located at strategic positions in the conveying path can be used to sense when a bag exceeds normal size limits or is otherwise improperly formed, and this information can be used to deactivate the next downstream air jet so that the bag is thus diverted from the normal flow. In this way, the separator/folder mechanism can provide an automatic reject feature.

The bag stacker mechanism is illustrated in greater detail in FIGS. 8 through 13. As shown, the bag stacker and indexing conveyor 30 functions basically to stack a predetermined number of folded bags 22, to compress the bags to reduce the size of the stack 130 and to transfer each of the resulting stacks 130 to a conveyor 132 for further processing.

Figure 8:
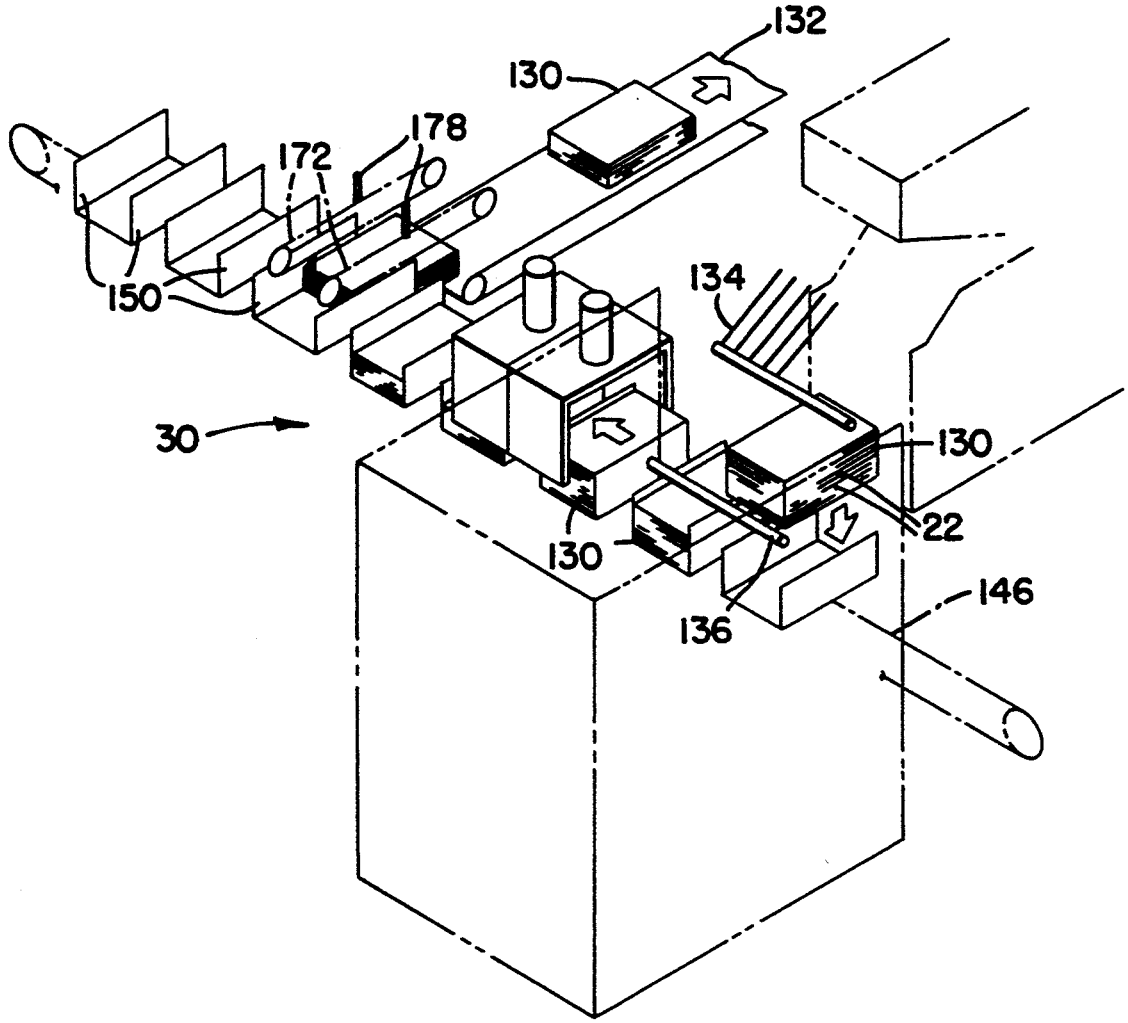
FIG. 8 is a simplified perspective view of a stacker and conveyor mechanism for handling separated and folded bags developed by the separator/folder.
Figure 9:
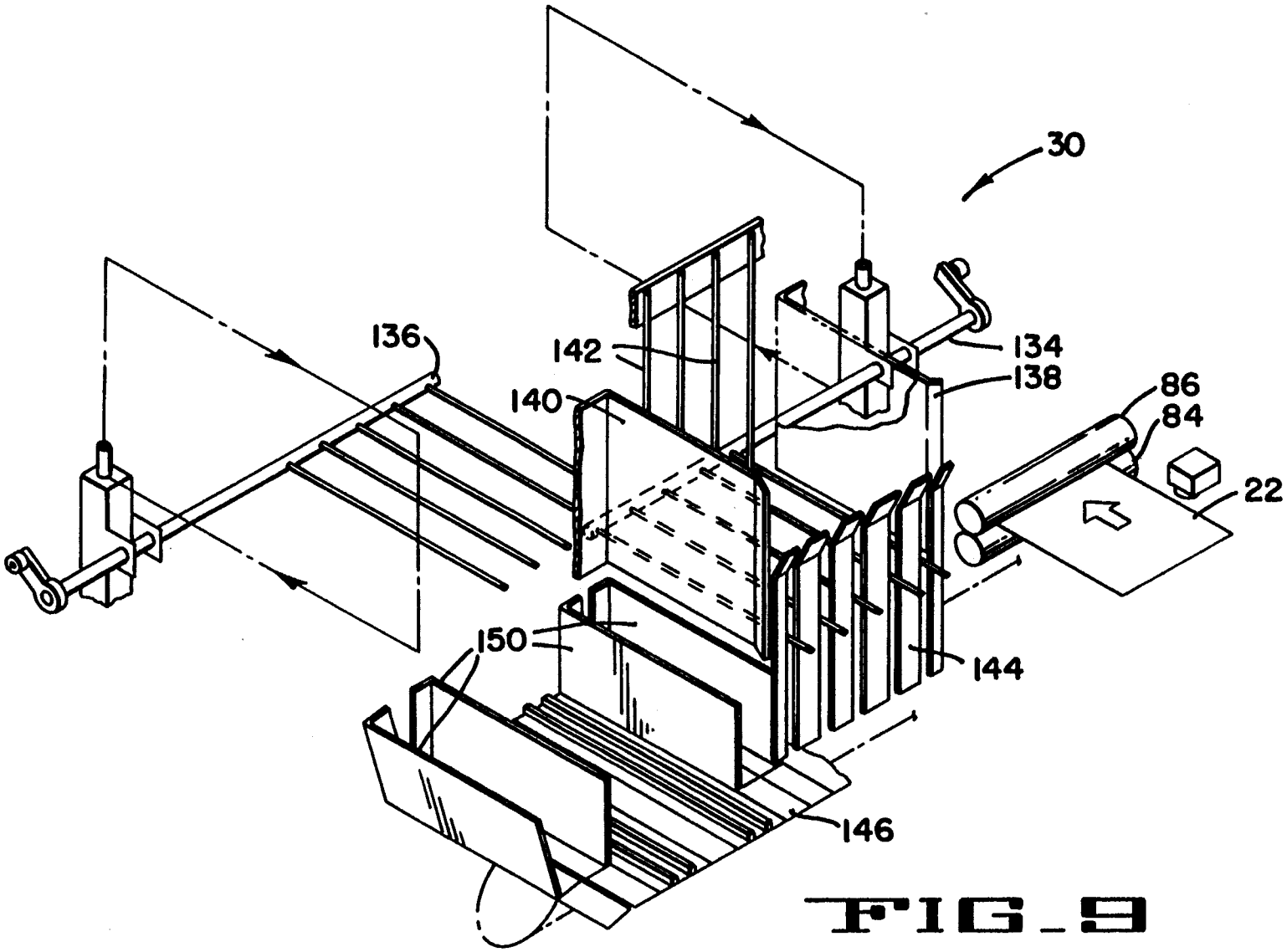
FIG. 9 is a perspective view of one portion of the stacker mechanism shown in FIG. 8, useful in understanding the operation of the stacking finger mechanism that functions to lower a stack of folded bags onto a conveyor.

Referring to FIGS. 8 and 9, the bag stacker 30 includes a pair of stacking finger assemblies 134, 136 on which folded bags 22 delivered by the separator/folder mechanism 28 are initially deposited. The stacking fingers 134, 136 cooperate with a pair of side guides 138, 140, a plurality of back stop rods 142 and a front guide 144 to define a rectangular chamber for receiving the folded bags 22. Use of the side guides, back stop rods and front guide ensures that the bags remain perfectly aligned within the stack 130.

The two sets of stacking fingers 134, 136 operate in a generally rectangular motion so that bags stacked onto the stacking fingers are lowered onto the underlying indexing conveyor 146. When a predetermined number of bags have been accumulated upon one of the stacking finger assemblies 143, 136, that stacking finger assembly lowers the stack onto the conveyor 146 while the other stacking finger assembly moves into position to receive the next series of folded bags delivered by the separator/folder 28. Continuous operation of the stacking fingers in this manner avoids the need to interrupt the flow of folded bags from the separator/folder 28.

Figure 10:
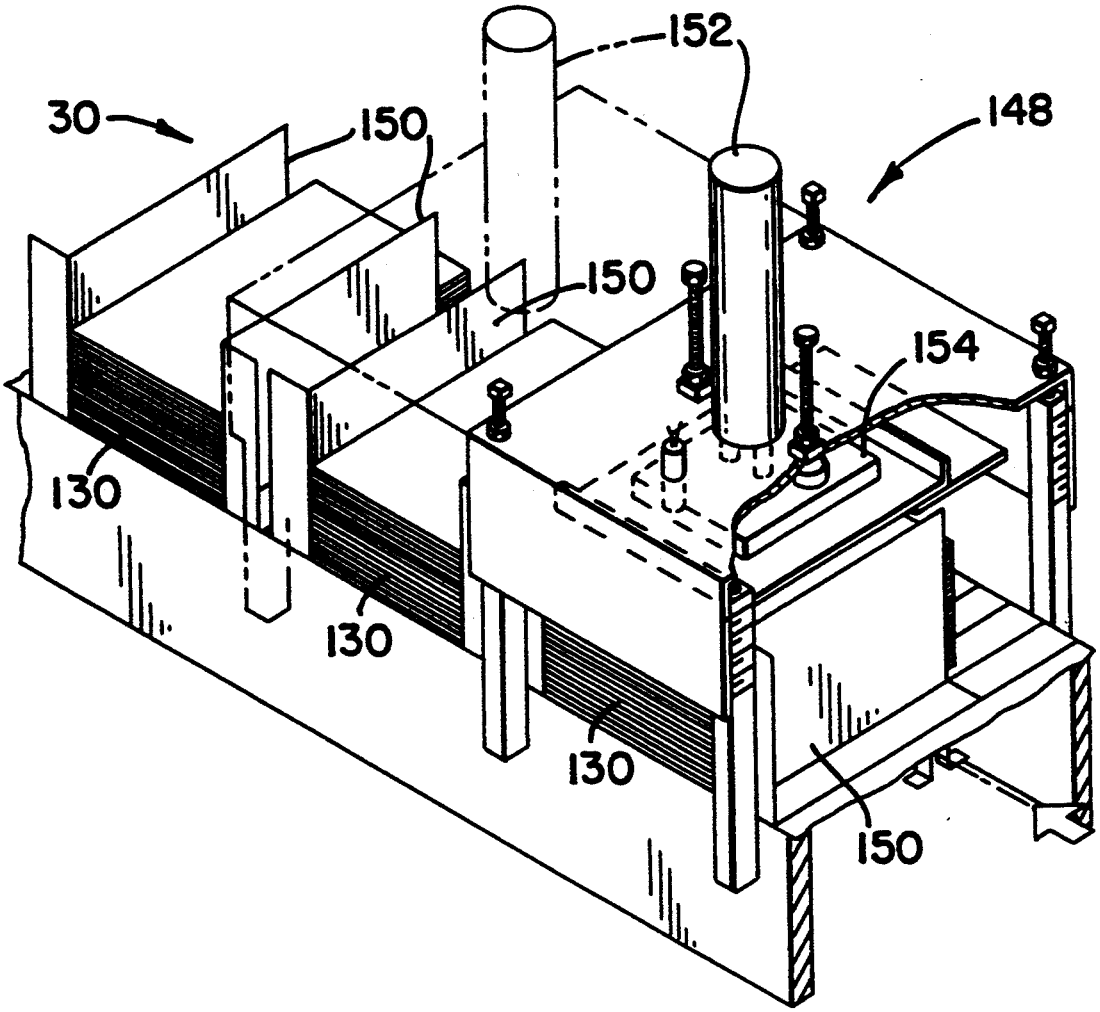
FIG. 10 is a perspective view of a portion of the bag stacker useful in understanding the construction and operation of a compressing mechanism for compressing a stack of folded bags.
Figure 11:
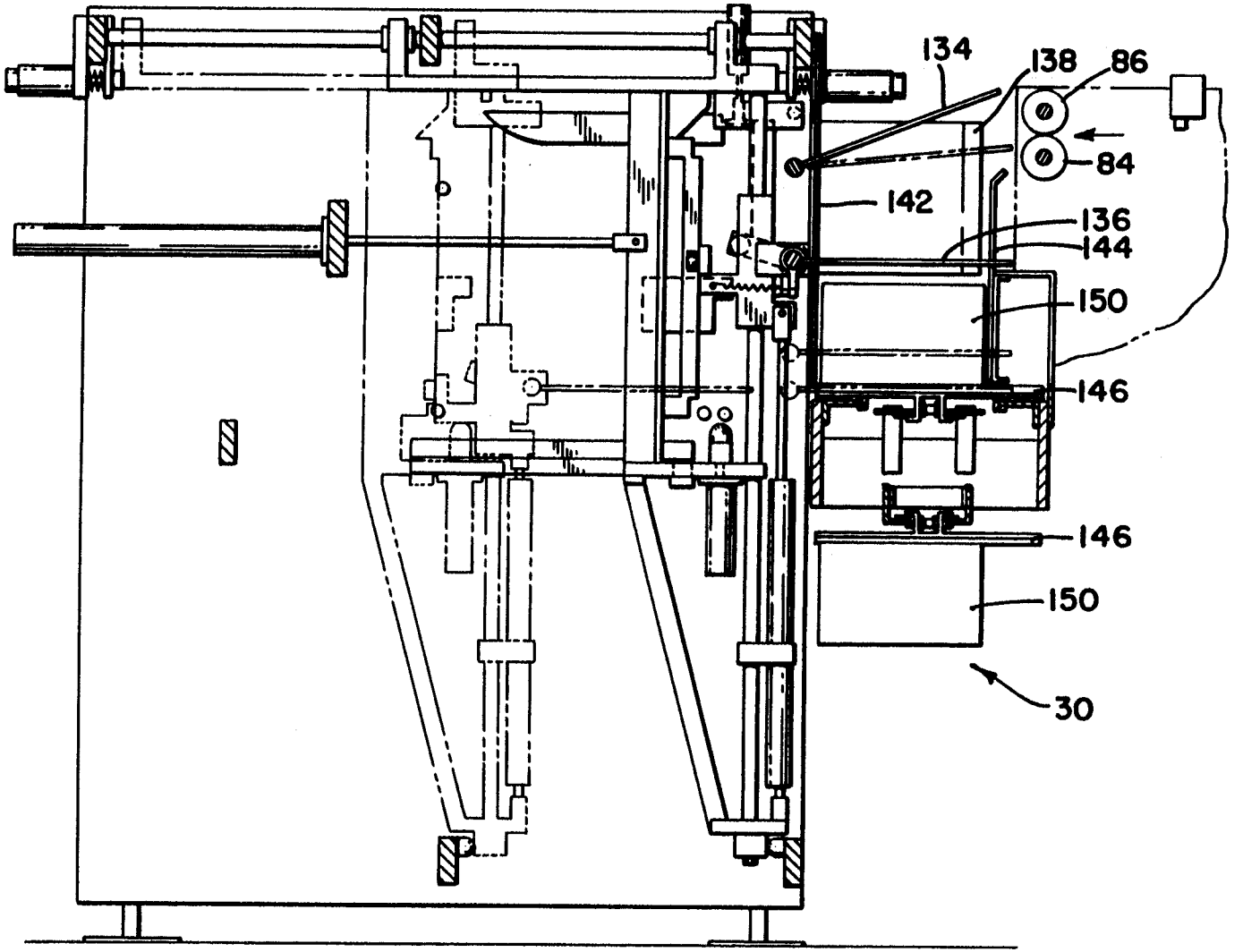
FIG. 11 is a side elevation view of the bag stacker shown in FIGS. 8–10.
Figure 12:
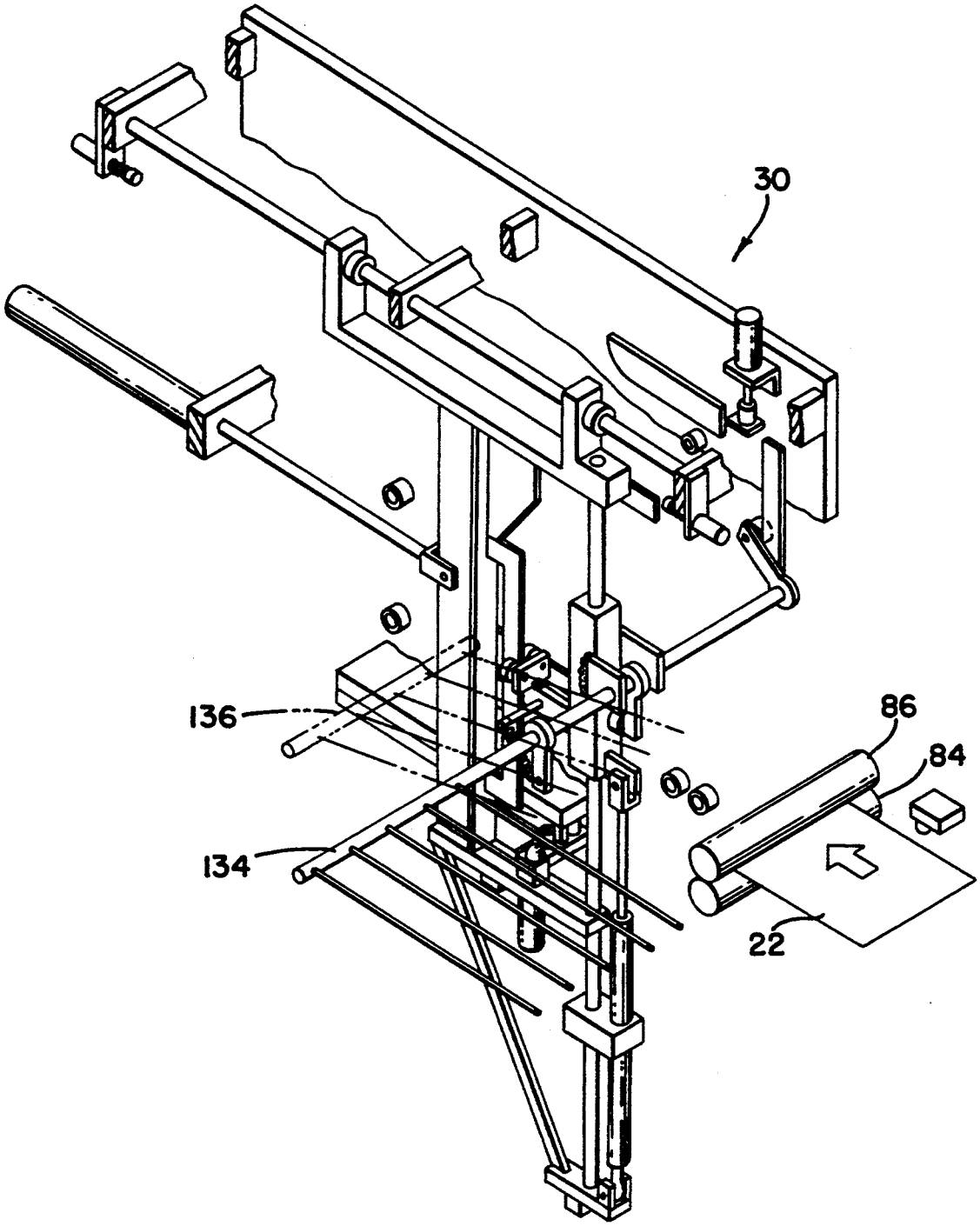
FIG. 12 is a simplified perspective view showing the drive linkage for actuating the stacker finger mechanism.

After each stack of bags is delivered to the indexing conveyor 146, the stack 130 is next transferred to a compressing station 148 shown in detail in FIG. 10. The compressing station 148 includes a plurality of guides 150 that support the sides of the stack 130 and ensure that the bags 22 within the stack 130 remain perfectly aligned during the compressing operation. Preferably, two compressing stations are included so that each stack is compressed twice to remove air from between the bags.

Each compressing station includes, in addition to the guides 150, a pneumatically driven ram 152 connected to a compression plate 154. When the ram 152 is actuated, the plate 154 is pressed downwardly onto the top of the stack 130 thereby driving air from between the bags and reducing the size of the overall stack 130. After being compressed at the first compressing station, the stack is compressed once again at the next downstream station that operates in the same manner.

Figure 13:
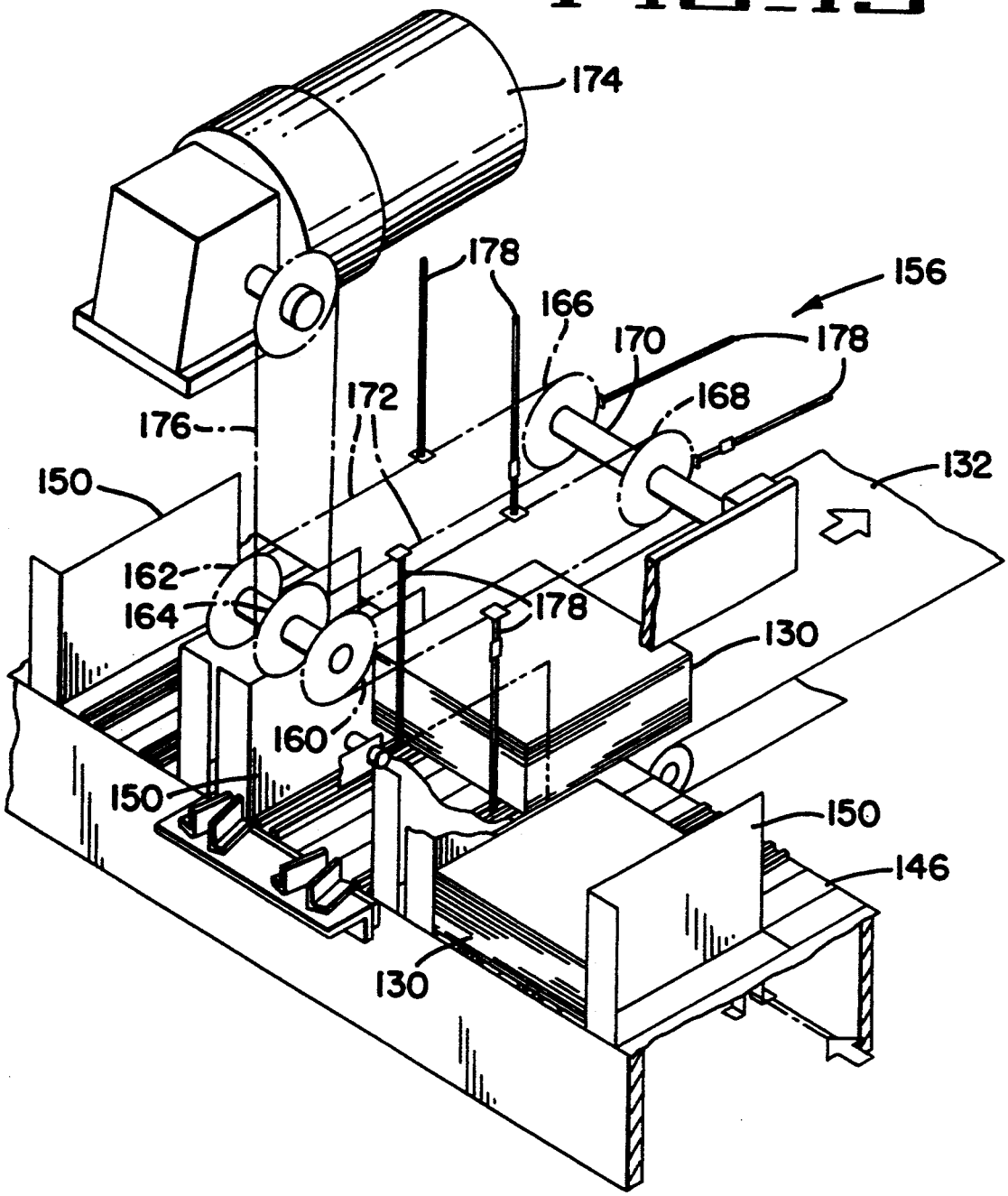
FIG. 13 is a perspective view showing the drive mechanism for operating the stack conveyor.

Downstream of the dual station compressor, the stacker mechanism includes a stack transfer mechanism 156, shown in FIG. 13. The stack transfer mechanism 156 includes a stop 158 against which the individual stacks 130 come to rest upon delivery by the indexing conveyor. The packaging machine conveyor 132, which leads downstream to additional packaging machinery, is located just forward the stack 130. A pair of sprockets 160, 162 rotatable around a horizontal shaft 164 are positioned behind the stack 130, and an additional pair of sprockets 166, 168, also rotatable around a horizontal shaft 170, is positioned forward of the stack 170 over the packaging machine conveyor 172. A pair of parallel transfer chains 172 are looped over the opposed sprockets so as to extend above and substantially parallel to both the stack 130 and the packaging machine conveyor 132. A motor 174 is coupled through a drive belt 176 to the sprockets thereby driving each transfer chain 170 in a continuous loop. Opposed pairs of transfer fingers 178 are mounted on the parallel transfer chains 170 and extend downwardly behind the stack 130 during normal circulation of the chains 170. As the chains continue to circulate, the transfer fingers 178 push the stack 130 onto the packaging machine conveyor 132. The next stack 130 is then delivered up against the stop 158 after which the next pair of transfer fingers 178 push the stack onto the packaging conveyor 132.

While a particular embodiment of the invention has been shown and described, it will be obvious to those skilled in the art that changes and modifications may be made without departing from the invention in its broader aspects, and, therefore, the aim in the appended claims is to cover all such changes and modifications as fall within the true spirit and scope of the invention.

We claim:

1. A separator for separating individual sheets from a continuous plastic web having transverse perforation formed therein, said perforations formed by means of a perforating knife upstream of said separator, said separator further includes a position indicator coupled to said perforating knife upstream of said separator;

an infeed mechanism for advancing the plastic web at a predetermined speed;

a pair of nip rollers located downstream of said feed mechanism and mounted for reciprocating movement into and out of engagement with each other, said rollers operating when engaged to advance said web at a speed greater than said predetermined speed so as to cause said web to separate along said perforation between said nip rollers and said infeed mechanism;

a linkage including an eccentric coupled to one of said nip rollers for reciprocating said nip roller into engagement with the other nip roller in response to rotation of said eccentric;

a servo motor for rotating said eccentric, said servo motor being means responsive to said position indicator coupled to said perforating knife so that a nip roller is reciprocated into engagement with the other nip roller and thereby cause said web to separate along the perforation between said nip rollers and said infeed mechanism.

2. A separator as defined in claim 1 wherein said servo motor is coupled to said eccentric through a timing belt.

* * * * *